US009775485B2

(12) United States Patent
Scholten et al.

(10) Patent No.: US 9,775,485 B2
(45) Date of Patent: Oct. 3, 2017

(54) AUTONOMOUS FLOOR CLEANER

(71) Applicant: BISSELL Homecare, Inc., Grand Rapids, MI (US)

(72) Inventors: Jeffrey A. Scholten, Ada, MI (US); Michael T. Dillane, Grand Rapids, MI (US); Tyler James Imhoff, Cedar Springs, MI (US); Scott M. Rose, Allendale, MI (US); Adam Luedke, Holland, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 579 days.

(21) Appl. No.: 14/294,532

(22) Filed: Jun. 3, 2014

(65) Prior Publication Data

US 2014/0352086 A1 Dec. 4, 2014

Related U.S. Application Data

(60) Provisional application No. 61/830,282, filed on Jun. 3, 2013.

(51) Int. Cl.

| | |
|---|---|
| ***A47L 11/24*** | (2006.01) |
| ***A47L 11/33*** | (2006.01) |
| ***A47L 11/40*** | (2006.01) |

(52) U.S. Cl.

CPC ..... *A47L 11/24* (2013.01); *A47L 11/33* (2013.01); *A47L 11/4013* (2013.01); *A47L 11/4025* (2013.01); *A47L 11/4036* (2013.01); *A47L 11/4038* (2013.01); *A47L 11/4061* (2013.01); *A47L 11/4066* (2013.01); *A47L 11/4069* (2013.01); *A47L 11/4072* (2013.01); *A47L 2201/00* (2013.01)

(58) Field of Classification Search

CPC ..... A47L 11/24; A47L 11/282; A47L 11/292; A47L 11/33; A47L 2201/00

See application file for complete search history.

(56) References Cited

U.S. PATENT DOCUMENTS

| | | | |
|---|---|---|---|
| 4,369,543 | A | 1/1983 | Chen et al. |
| 5,032,775 | A | 7/1991 | Mizuno et al. |
| 5,279,672 | A | 1/1994 | Betker et al. |
| 5,309,592 | A | 5/1994 | Hiratsuka |
| 5,548,511 | A | 8/1996 | Bancroft |
| 5,787,545 | A | 8/1998 | Colens |
| 5,815,880 | A | 10/1998 | Nakanishi |
| 5,959,423 | A | 9/1999 | Nakanishi et al. |
| 5,995,844 | A | 11/1999 | Fukuda |
| 5,995,884 | A | 11/1999 | Allen et al. |
| 6,446,302 | B1 | 9/2002 | Kasper et al. |
| 6,457,206 | B1 | 10/2002 | Judson |
| 6,459,955 | B1 | 10/2002 | Bartsch et al. |
| 6,481,515 | B1 | 11/2002 | Kirkpatrick et al. |

(Continued)

FOREIGN PATENT DOCUMENTS

| | | | |
|---|---|---|---|
| CN | 102525333 | A | 7/2012 |

*Primary Examiner* — Randall Chin

(74) *Attorney, Agent, or Firm* — McGarry Bair PC

(57) ABSTRACT

An autonomous floor cleaner includes a base that is movable over a surface to be cleaned, a collection chamber associated with the base, and a rotating top mounted coupled with the base for rotation relative to the base, where the top carries at least one sweeping element for sweeping dirt on the surface to be cleaned toward the collection chamber.

20 Claims, 16 Drawing Sheets

(56) References Cited

U.S. PATENT DOCUMENTS

| | | | | |
|---|---|---|---|---|
| 6,574,536 | B1 | 6/2003 | Kawagoe et al. | |
| 6,580,246 | B2 | 6/2003 | Jacobs | |
| 6,594,844 | B2 | 7/2003 | Jones | |
| 6,633,150 | B1 | 10/2003 | Wallach et al. | |
| 6,925,679 | B2 | 8/2005 | Wallach et al. | |
| 6,938,298 | B2 | 9/2005 | Aasen | |
| 7,024,278 | B2 | 4/2006 | Chiappetta et al. | |
| 7,113,847 | B2 | 9/2006 | Chmura et al. | |
| 7,155,308 | B2 | 12/2006 | Jones | |
| 7,320,149 | B1 | 1/2008 | Huffman et al. | |
| 7,346,428 | B1 | 3/2008 | Huffman et al. | |
| 2002/0002751 | A1 | 1/2002 | Fisher | |
| 2003/0060928 | A1 | 3/2003 | Abramson et al. | |
| 2004/0031113 | A1 | 2/2004 | Wosewick et al. | |
| 2004/0031121 | A1 | 2/2004 | Martin et al. | |
| 2005/0166356 | A1* | 8/2005 | Uehigashi | A47L 5/30 15/319 |
| 2010/0228395 | A1* | 9/2010 | Lin | A47L 9/00 700/258 |

* cited by examiner

AUTONOMOUS FLOOR CLEANER

CROSS-REFERENCE TO RELATED APPLICATION

This application claims the benefit of U.S. Provisional Patent Application No. 61/830,282, filed Jun. 3, 2013, which is incorporated herein by reference in its entirety.

BACKGROUND

Autonomous or robotic floor cleaners can move without the assistance of a user or operator in order to clean a floor surface. For example, the floor cleaner can be configured to sweep dirt (including dust, hair, and other debris) into a collection bin carried on the floor cleaner and/or to sweep dirt using a cloth which collects the dirt. The floor cleaner can move randomly about a surface while cleaning the floor surface.

BRIEF SUMMARY

In one aspect of the invention, an autonomous floor cleaner includes a base adapted for movement over a surface to be cleaned, a top coupled with the base, at least one sweeping element associated with the top, a collection chamber associated with the base, and a drive system associated with the base, wherein the drive system is coupled to the top to rotate the top relative to the base about a top axis.

DETAILED DESCRIPTION

Figure 1:
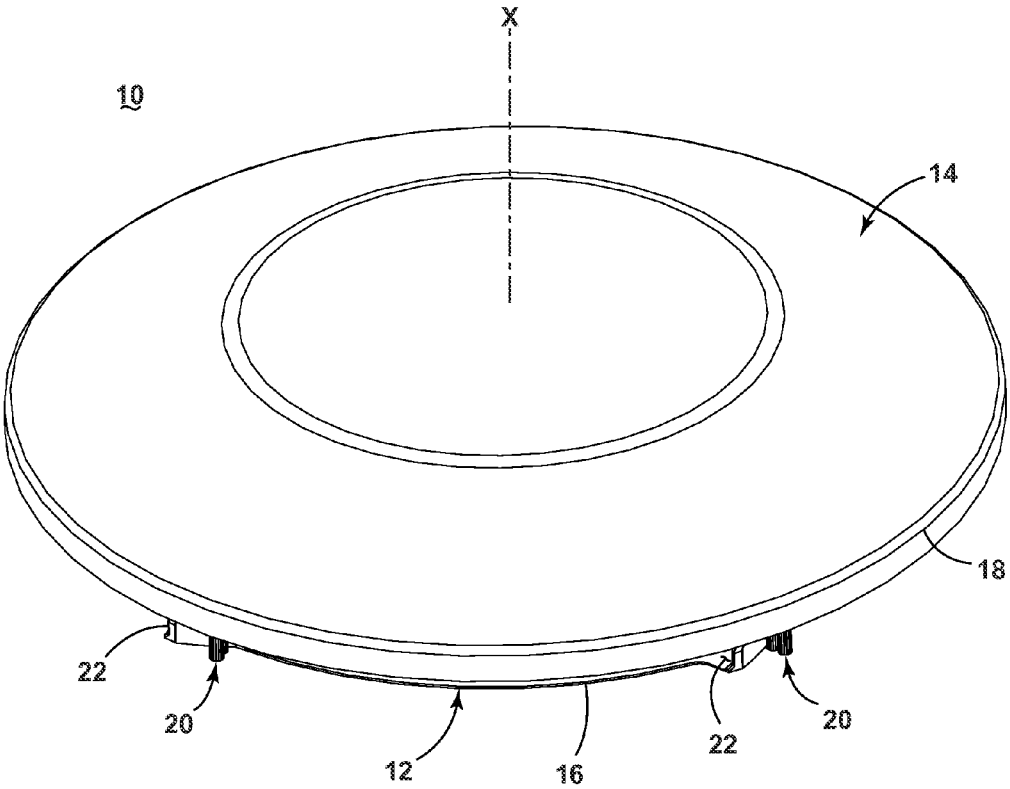
FIG. 1 is a perspective view of an autonomous floor cleaner according to a first embodiment of the invention.

FIG. 1 is a front perspective view of an autonomous floor cleaner 10 according to a first embodiment of the invention.

The autonomous floor cleaner 10 has been illustrated as a robotic sweeper that mounts the components of the sweeper in an autonomously moveable unit, including components of a sweeping and collection system for mechanically moving dirt on a surface to be cleaned into a collection space on the floor cleaner 10, and a drive system for autonomously moving the floor cleaner 10 over the surface to be cleaned. While not illustrated, the autonomous floor cleaner 10 could be provided with additional capabilities, such as a navigation system for guiding the movement of the floor cleaner 10 over the surface to be cleaned, a dispensing system for applying a treating agent stored on the floor cleaner 10 to the surface to be cleaned, and a vacuum system for generating a working air flow for removing dirt, liquid and/or a treating agent from a surface to be cleaned.

The autonomous floor cleaner 10 includes base or platform 12 and an enclosure or top plate 14 on the platform 12. The platform 12 provides the basic structure for the robotic sweeper on which many of the components of the floor cleaner 10 depend for structural support. As shown herein, both the platform 12 and top plate 14 are substantially circular in shape, and each define an outer periphery 16, 18, respectively. Other shapes for the floor cleaner 10 are possible.

The drive system moves the platform 12 over the surface to be cleaned. The sweeping and collection system rotates the top plate 14 about a rotational axis X above the platform 12, independently of the movement of the platform 12 over the surface to be cleaned. The rotational axis X can be generally vertically oriented with respect to the surface to be cleaned, such that the rotational axis X is perpendicular to the direction of movement of the platform 12. The sweeping and collection system further includes one or more sweeping elements 20 mounted to the top plate 14 and multiple dirt inlets 22. The dirt inlets 22 are located at the outer peripheries 16, 18 of the platform 12 and top plate 14.

Figure 2:
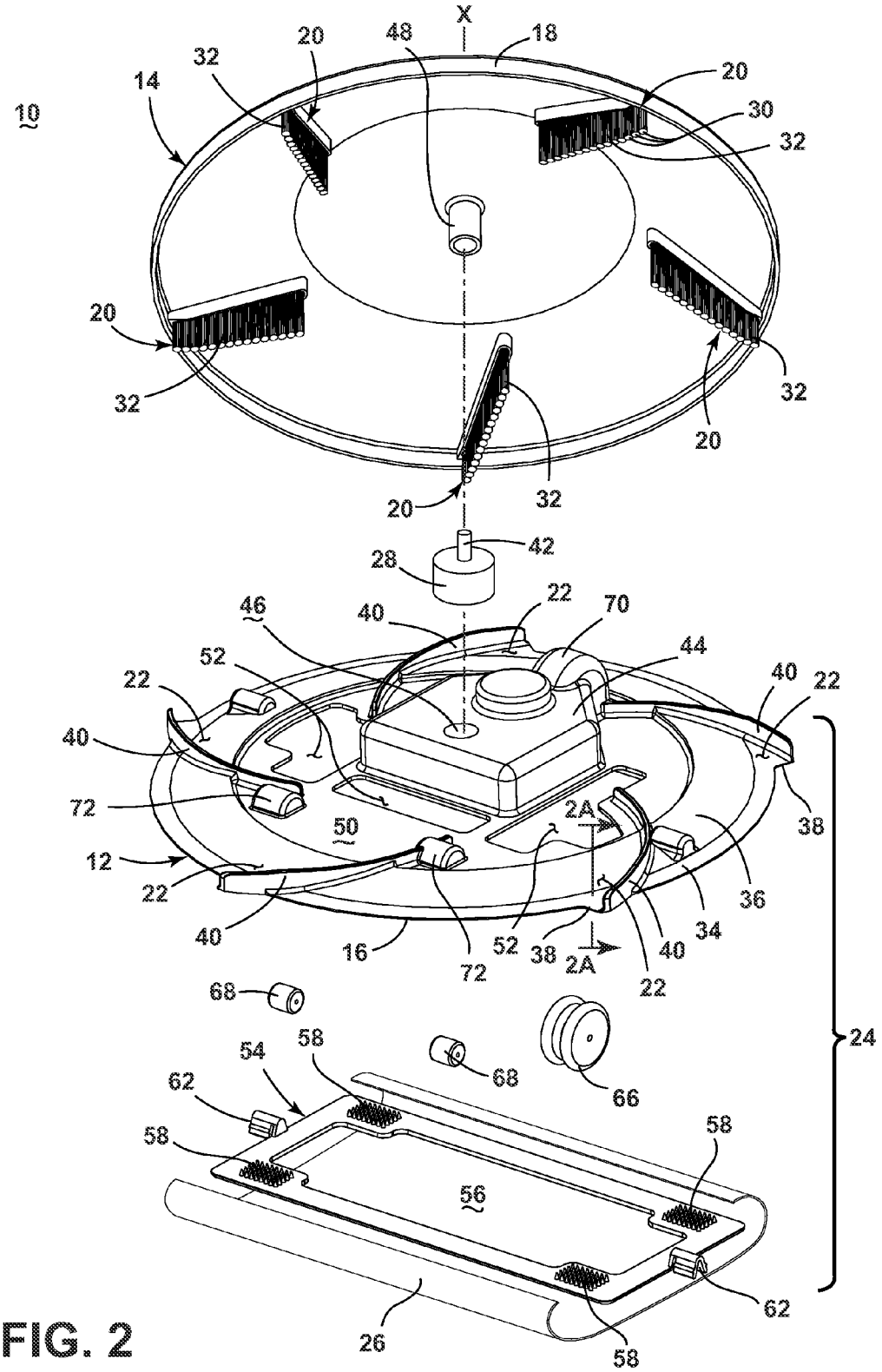
FIG. 2 is an exploded view of the autonomous floor cleaner from FIG. 1.

FIG. 2 is an exploded view of the autonomous floor cleaner 10 from FIG. 1. The sweeping and collection system further includes a collection chamber 24 adapted to collect dirt and other contaminants for later disposal, a dusting cloth 26 that can at least partially form the collection chamber 24, and a motor 28 coupled to the top plate 14 for rotating the top plate 14 about the rotational axis X.

The one or more sweeping elements 20 are at least partially in register with the floor surface, and can include multiple sweeping elements 20 which extend downwardly from the underside of the top plate 14. The floor cleaner 10 shown herein uses brushes as sweeping elements 20, each of which includes a plurality of bristle tufts 30 arranged in a strip 32. The brush strips 32 can be disposed at the periphery 18 of the top plate 14 and can be spaced from each other and diametrically offset relative to the top plate 14. The bristle tufts 30 can be arranged in generally linear rows such that the brush strips 32 are straight; alternatively, the bristle tufts 30 can be arranged in curved or helical rows. Optionally, the outboard tufts 30 can be angled or flared outwardly so that the ends of those tufts 30 extend beyond the periphery 18 of the top plate 14. The platform 12 can cover the inner ends of the brush strips 32, such that only the outermost portions of the brush strips 32 are in register with the floor surface. The remaining portions of the brush strips 32 are in register with the top or inner surface of the platform 12.

Figure 2A:
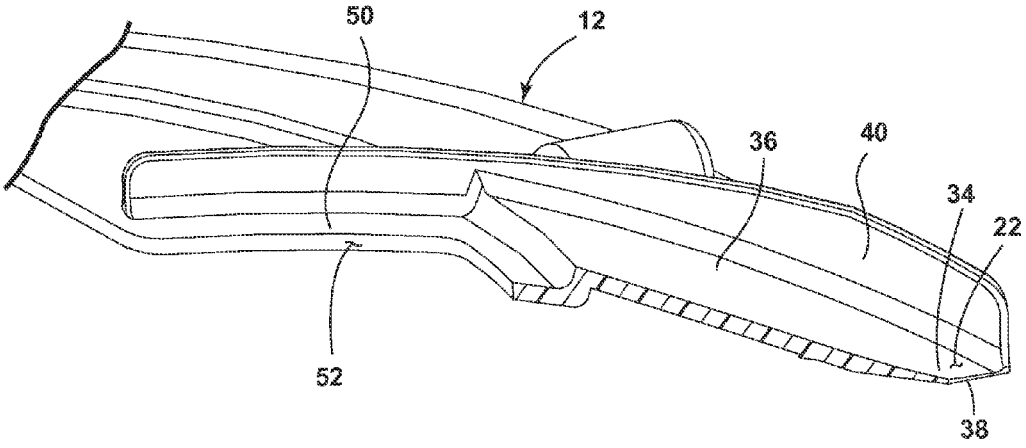
FIG. 2A is a cross-sectional view through line 2A-2A of FIG. 2.

With additional reference to FIG. 2A, the dirt inlets 22 are at least partially defined by ramped surfaces on the top or inner side of the platform 12 which help direct dirt swept by the sweeping elements 20 toward the collection chamber 24 and which can correspond in number to the number of sweeping elements 20. The dirt inlets 22 can be formed by an angled flange 34 extending around the perimeter of the platform 12 and a ramp 36 likewise extending around the perimeter of the platform 12 but inwardly of the angled flange 34. The angled flange 34 and ramp 36 can each have continuous angles of incline around the perimeter of the platform 12, but can be inclined at different angles from each other. As shown here, the angled flange 34 is steeper than the ramp 36. The angled flange 34 can have inlet extensions 38 which project radially outwardly from the periphery 16 of the platform 12 and form an entrance for dirt to the dirt inlets 22.

As illustrated, the angled flange 34 and ramp 36 are formed integrally as a portion of the entire platform 12, which can comprise a rigid thermoplastic material such as acrylonitrile butadiene styrene (ABS), for example. Alternatively, the inner portion of the platform 12 can be formed of a rigid thermoplastic material as indicated previously, whereas the peripheral portion of the platform 12, including the flange 34 and ramp 36, can be formed of a dissimilar material, such as a flexible, resilient material with a low coefficient of friction. Representative examples are polypropylene (PP) or polyethylene (PE), for example. The flexible, resilient portion of the platform 12 can be chemically or mechanically bonded to the rigid portion of the platform 12 by adhesive, mechanical fasteners, plastic welding or a conventional overmolding injection molding process, for example. The flexible, resilient portion of the platform 12 can be configured to conform to variations in the surface to be cleaned so that the angled flange 34 slides on the surface to be cleaned for improved cleaning performance.

The dirt inlets 22 are further defined by guides 40 which catch and guide dirt into the collection chamber 24. The brush strips 32 can be configured to slide up and over the guides 40 to push dirt inwardly toward the collection chamber 24. The guides 40 can be formed as curved or arcuate vanes which project upwardly from the top or inner surface of the platform 12, and which extend along the angled flange 34 and ramp 36. The guides 40 are disposed at the periphery 16 of the platform 12 and extend generally radially from the center of the platform 12 in a spiral pattern.

The top plate 14 is coupled to the motor 28 by a drive shaft 42 that defines the rotational axis X. The motor 28 can be located within a motor chamber 44 provided on the platform 12, above the collection chamber 24, having a shaft aperture 46 through which the drive shaft 42 can protrude to couple with the top plate 14 at a coupling 48. The shaft 42 can be directly driven by the motor 28, or can be indirectly driven by the motor 28, such as by the provision of a transmission between the motor 28 and the shaft 42.

The platform 12 further includes a centrally located recessed region 50 that is inward of the ramp 36. One or more dirt openings 52 are formed in the recessed region 50 and lead to the collection chamber 24. The dirt openings 52 can be positioned at or near the ends to the guides 40 such that dirt guided up the ramp 36 by the sweeping elements 20 is deposited in the collection chamber 24.

The collection chamber 24 includes a bottom plate 54 that is attached to a bottom surface of the platform 12. The bottom plate 54 defines the bottom of the collection chamber 24 and the dirt openings 52 are open to the space above the bottom plate 54. The bottom plate 54 can have one or more plate opening(s) 56 formed therein.

In addition to defining the bottom of the collection chamber 24, the bottom plate 54 also removably mounts the dusting cloth 26. The dusting cloth 26 can be a pad or sheet of non-woven material such as polypropylene or microfiber. Alternatively, the dusting cloth 26 can comprise a conventional woven material such as cotton fabric rag, for example. The dusting cloth 26 wraps around and covers the plate opening 56. The bottom plate 54 can be provided with grippers 58 for holding the dusting cloth 26 on the bottom plate 54. Other means for holding the dusting cloth 26 on the bottom plate 54 include high friction, elastomeric strips and hook and loop fasteners.

The bottom plate 54 can be at least partially removable from the platform 12 to enable the attachment or detachment of the dusting cloth 26, as well as the emptying of the collection chamber 24. To mount the dusting cloth 26 to the bottom plate 54, the bottom plate 54 is opened or removed from the platform 12, the dusting cloth 26 is wrapped around the plate with the ends of the dusting cloth 26 held by the grippers 58, and the bottom plate 54 is reattached to the platform 12 using the fasteners.

Figure 3:
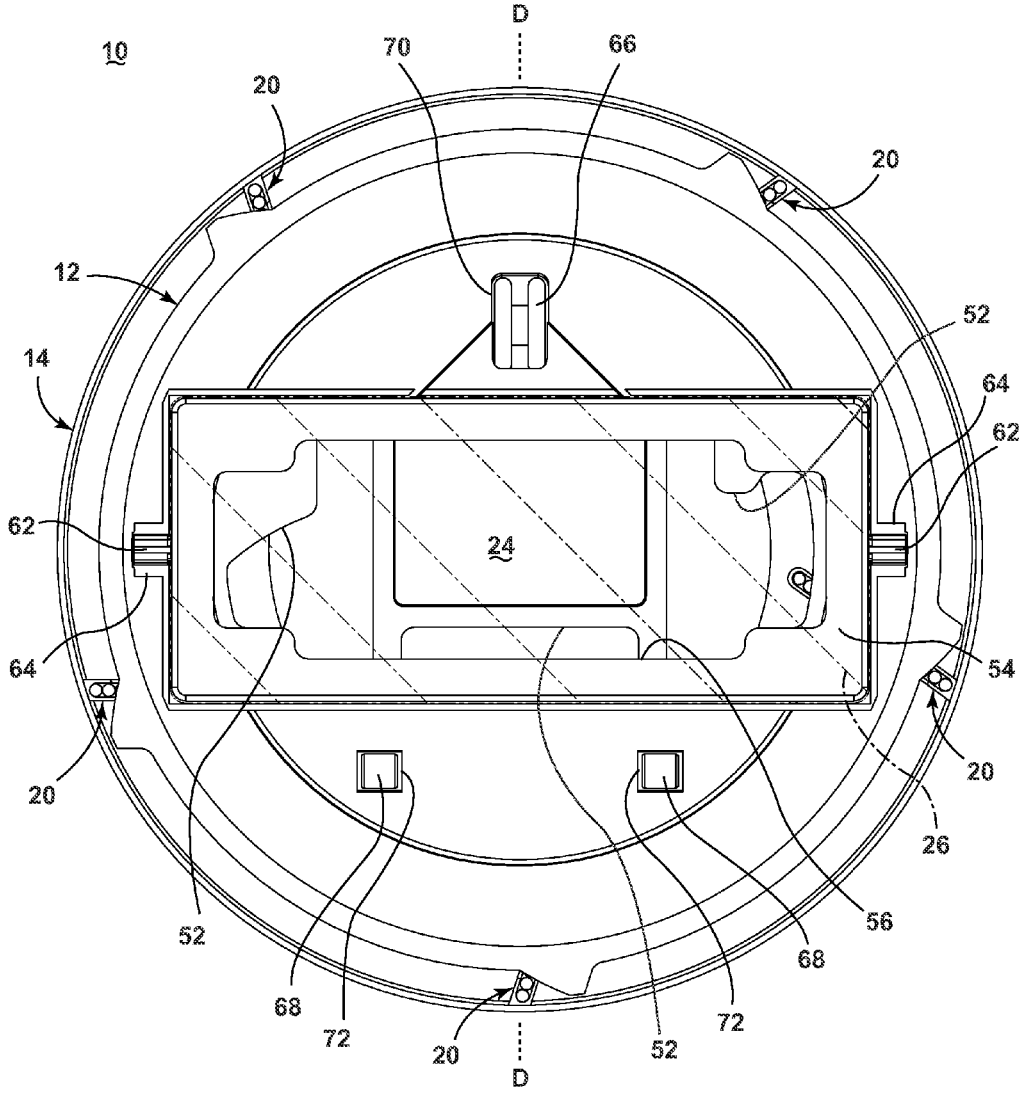
FIG. 3 is a bottom view of the autonomous floor cleaner from FIG. 1.

FIG. 3 is a bottom view of the autonomous floor cleaner 10 from FIG. 1. For clarity, the dusting cloth 26 is indicated in phantom line in FIG. 3. A fastener can be provided for securing the bottom plate 54 in a closed position on the platform 12. As shown herein, the bottom plate 54 includes two detents 62 that fit within detent receivers 64 on the bottom of the platform 12 to fasten the bottom plate 54 to the platform 12 in the closed position. Other fasteners can be used, such as, but not limited to, latches, screws, snaps or hook and loop fasteners. The bottom plate 54 can be completely removable from the platform 12 as shown in the illustrated embodiment, or can be hinged to the platform 12 to selectively move between open and closed positions.

The dusting cloth 26 can be removed from the floor cleaner 10 without removing the bottom plate 54, such that removal of dusting cloth 26 opens the collection chamber 24 by exposing the plate opening 56. During operation, dirt collects both in the collection chamber 24 and on the bottom of the dusting cloth 26. When a cleaning operation is done, the user can hold the floor cleaner 10 over a waste receptacle, and pull off and throw away the dirty dusting cloth 26 in one motion, which simultaneously also effectively "opens" the collection chamber 24 and allows collected dirt in the collection chamber 24 to fall though the plate opening 56.

Alternatively, the bottom plate 54 can be hingedly mounted to the platform 12 to permit facile emptying of the collection chamber 24 and to eliminate potential for dropping the plate 54 into the waste receptacle. One example of a hingedly mounted dust cloth mounting panel configuration is more fully disclosed in U.S. Pat. No. 7,013,528, issued Mar. 21, 2006, which is incorporated herein by reference in its entirety. In yet another configuration, the bottom plate 54 can be eliminated and the dusting cloth 26 can be attached directly to the bottom surface of the platform 12.

The drive system includes one or more wheels for propelling the floor cleaner 10 over a surface to be cleaned. As illustrated, the drive system includes three wheels; a drive wheel 66 and two roller wheels 68. The drive wheel 66 is rotatably mounted on the platform 12 and at least partially protrudes through a corresponding drive wheel receiver 70 located along a diameter D of the platform 12, between the center and the outer periphery 16 of the platform 12. The two roller wheels 68 are likewise rotatably mounted on the platform 12 and at least partially protrude through corresponding roller wheel receivers 72 which are located in spaced relation to the diameter D of the platform 12, between the center and the outer periphery 16 of the platform 12.

The drive wheel 66 can be coupled to the motor 28 such that activation of the motor 28 results in a corresponding rotation of the drive wheel 66 and movement of the floor cleaner 10. The drive wheel 66 can be coupled to the motor 28 via a suitable transmission (not shown). Alternatively, separate motors can be provided for rotating the top plate 14 for sweeping and for rotating the drive wheel 66 for driving the floor cleaner 10. The roller wheels 68 are not drivingly coupled to the motor 28, but rather are indirectly rotated by the movement of the floor cleaner 10 over the surface to be cleaned.

Figure 4:
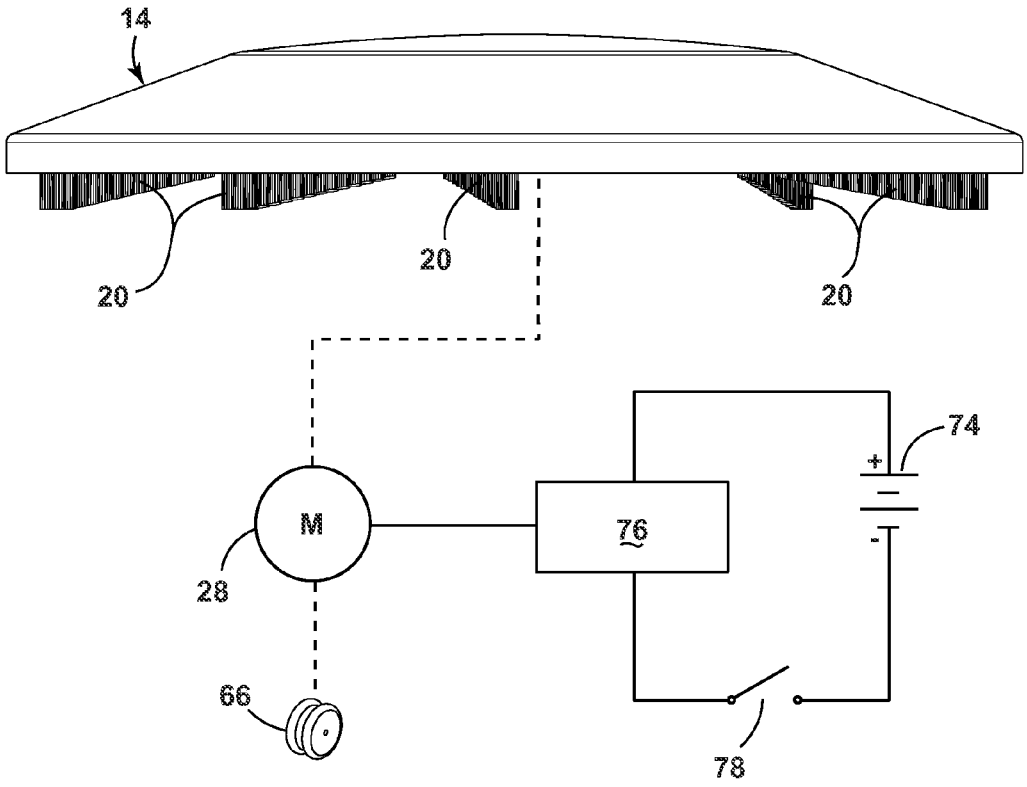
FIG. 4 is a schematic view of a drive system for the autonomous floor cleaner from FIG. 1.

FIG. 4 is a schematic view of the drive system for the autonomous floor cleaner 10 from FIG. 1. The drive system further includes a power source 74 operably coupled to the motor 28 for selectively powering the motor 28, and a controller 76 operably coupled with various components of the floor cleaner 10 to implement one or more cycles of operation, such as cleaning or recharging. The power source 74 can include a plurality of batteries mounted on the floor cleaner 10 that are rechargeable or replaceable. The batteries may be any commonly known battery including alkaline, nickel-cadmium, nickel-metal hydride (NiMH), or lithium ion. When rechargeable batteries are used, a recharging circuit can be provided to transform available facility voltage (such as a household outlet) to a level usable for the batteries. A charging plug or docking station (not shown) can be provided for connecting the floor cleaner 10 to the available facility voltage to complete the circuit and recharge the batteries.

The controller 76 may be operably coupled with one or more components of the floor cleaner 10 for communicating with and controlling the operation of the components to complete a cycle of operation. Power supply from the power source 74 can be controlled by a user-engageable switch 78 coupled to the controller 76. When switch 78 is closed, power flows to the motor 28, and the controller 76 provides output to drive the drive wheel 66. The output provided by the controller 76 may be conditioned by input from the drive system. For example, the drive system can be configured to turn the platform 12 when the floor cleaner 10 encounters an obstacle. One example of a suitable drive system in this regard is disclosed in U.S. Pat. No. 8,032,978 to Haegermarck, issued Oct. 11, 2011. Alternatively, the drive system can be configured for random movement and can comprise a drive wheel mounted within a pocket near the center of a housing as more fully disclosed in U.S. Pat. No. 6,938,298 to Aasen, issued Sep. 6, 2005. Alternatively, the floor cleaner 10 can be provided with a navigation system for guiding the movement of the floor cleaner 10 over the surface to be cleaned. In one example, the navigation system can employ one or more proximity sensors which provide navigation input to the controller 76, as more fully disclosed in U.S. Pat. No. 7,346,428 to Huffman et al., issued Mar. 18, 2008.

Figure 5:
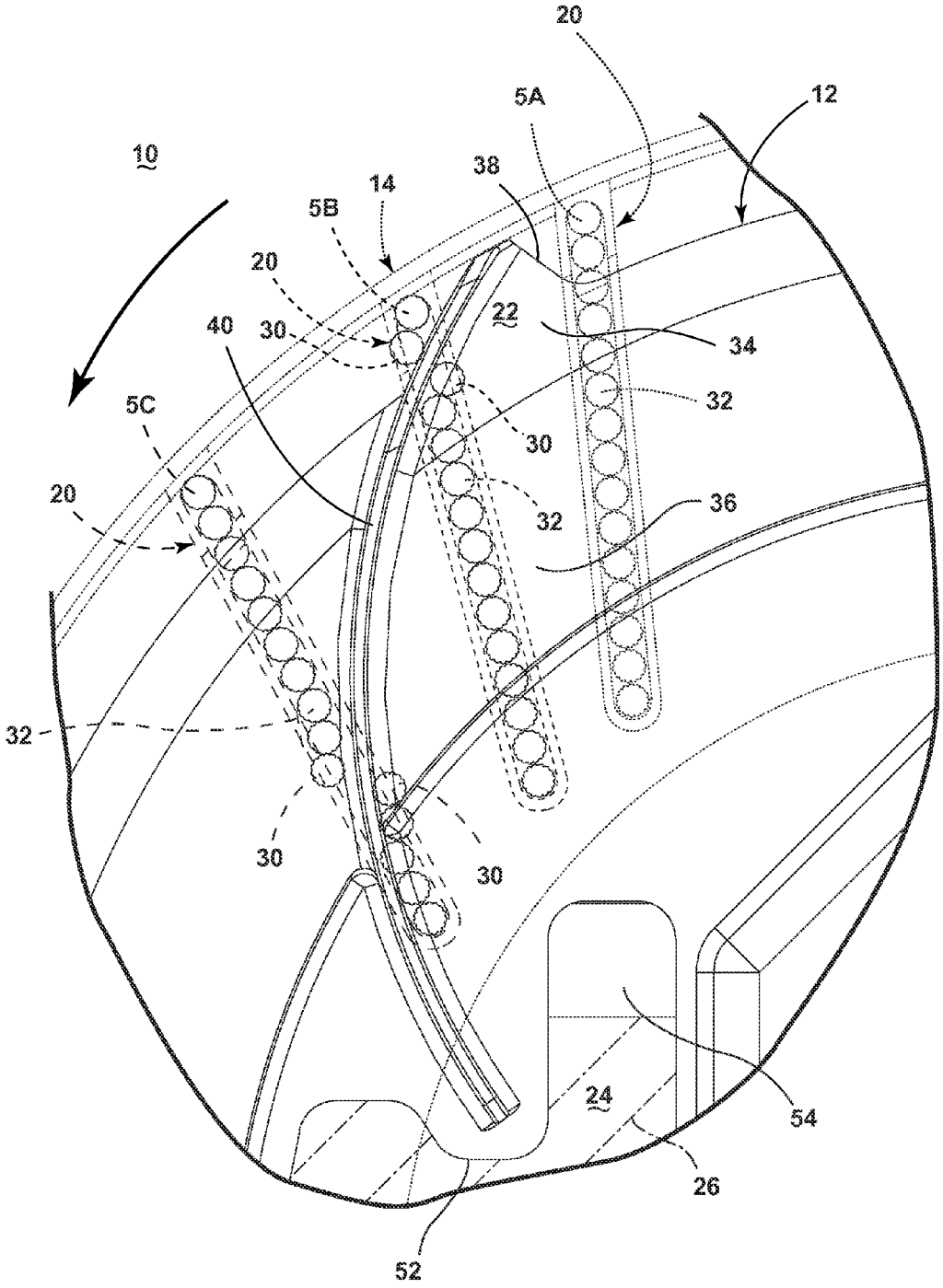
FIG. 5 illustrates a portion of the operation of the floor cleaner 10 from FIG. 1.

FIG. 5 illustrates a portion of the operation of the floor cleaner 10 from FIG. 1. For clarity, the top plate 14 and sweeping elements 20 are shown in phantom line. In operation, as the top plate 14 rotates, the brush strips 32 are configured to sweep dirt inwardly in a skimming or scooping motion through peripheral dirt inlets 22 formed in the platform 12, towards the centrally located collection chamber 24.

Some exemplary positions of one of the sweeping elements 20 are shown in FIG. 5 to illustrate the skimming or scooping motion. As the sweeping element 20 sweeps over the surface to be cleaned as indicated at 5A, dirt is guided toward the dirt inlet 22. The dirt enters the floor cleaner 10 at the inlet extension 38 and is guided up the angled flange 34 and onto the ramp 36. As the brush strip 32 rotates past the guide 40, the bristle tufts 30 begin to break over the guide 40 as indicated at 5B. The guide 40 prevents dirt from being carried with the top plate 14 as the brush strip 32 moves over the guide 40. The dirt is guided into collection chamber 24 via the dirt opening 52 located at the end of the guide 40; as shown herein the brush strips 32 may not push the dirt all the way into the collection chamber 24, but may provide enough motive force to move the dirt up the ramp 36 and into the dirt opening 52 as indicated at 5C.

Figure 6:
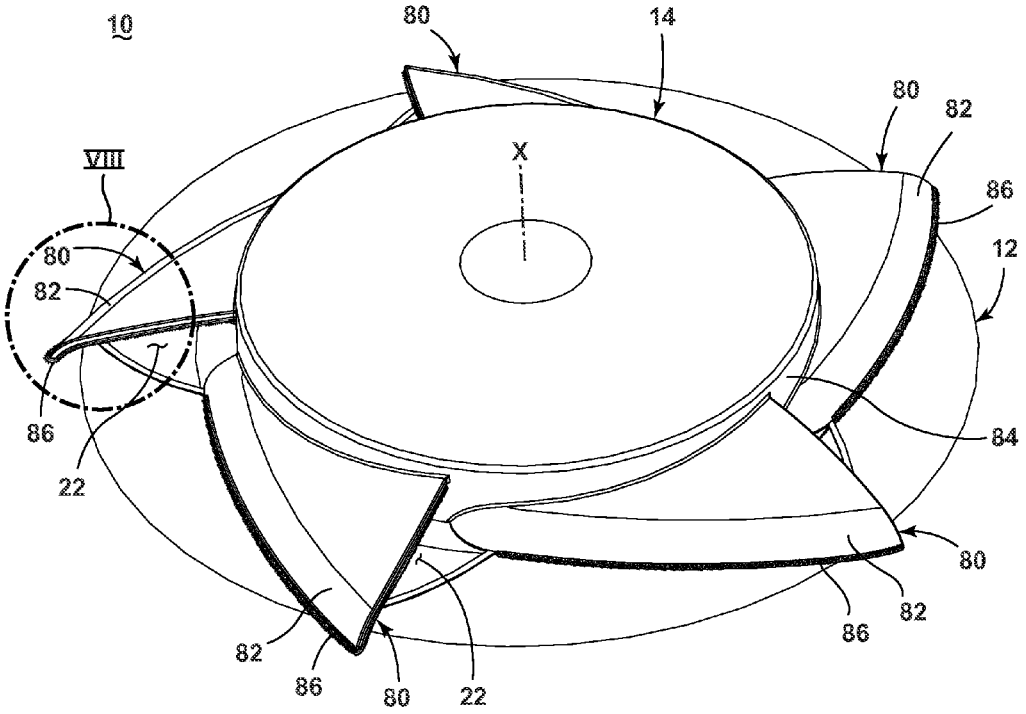
FIG. 6 is a perspective view of an autonomous floor cleaner according to a second embodiment of the invention.

FIG. 6 is a perspective view of an autonomous floor cleaner 10 according to a second embodiment of the invention. The second embodiment is substantially similar to the first embodiment, and like elements will be referred to with the same reference numerals. The second embodiment differs from the first embodiment in the configuration of the sweeping elements mounted to the top plate 14 and the dirt inlets 22. The sweeping elements can include flexible skimmers 80 that are at least partially in register with the floor surface. The skimmers 80 include resilient fins 82 which extend outwardly and downwardly from a central portion 84 of the top plate 14 and a sweeping material 86 on the floor-facing side of the fins 82.

Figure 7:
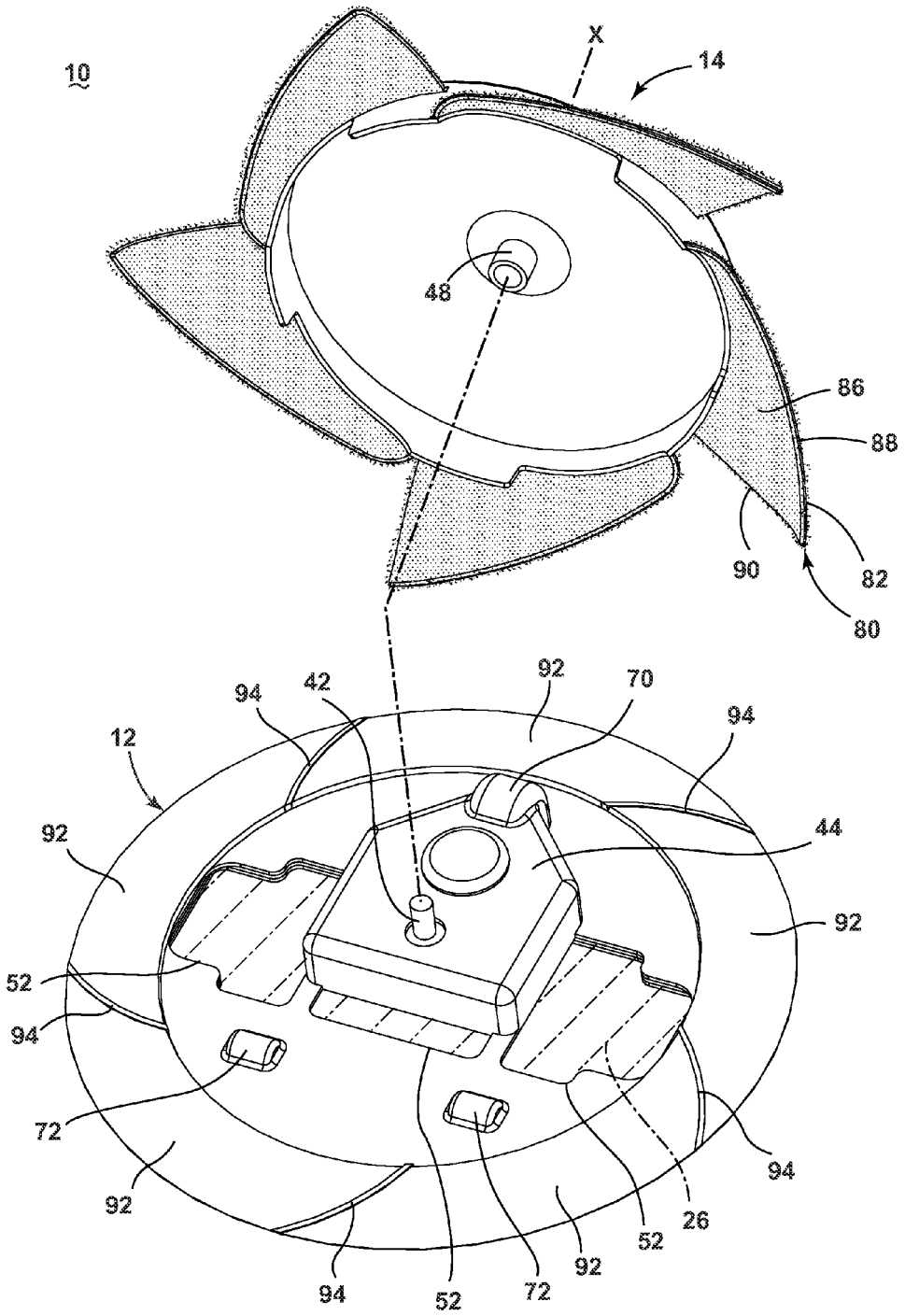
FIG. 7 is an exploded view of the autonomous floor cleaner from FIG. 6.

FIG. 7 is an exploded view of the autonomous floor cleaner 10 from FIG. 6. The fins 82 can be radially spaced from each other and each fin 82 includes a circumferentially-extending surface 88 connected to a radially-extending surface 90 at an outer corner of the fin 82, with both surfaces 88, 90 joining the central portion 84 of the top plate 14. The fin 82 can extend outwardly and downwardly from the central portion 84, with the circumferentially-extending surface 88 curving downwardly and the radially-extending surfaces 90 oriented at a downward angle with respect to the central portion 84.

The platform 12 can cover the inner ends of the skimmers 80, such that only the outermost portions of the sweeping material 86 on the fins 82 are in register with the floor surface. The remaining portions of the sweeping material 86 are in register with the top or inner surface of the platform 12.

The dirt inlets 22 are defined by the skimmers 80 and ramps 92 on the top or inner side of the platform 12 which help direct dirt swept by the sweeping elements 20 toward the collection chamber 24 and which can correspond in number to the number of sweeping elements 20. The ramps 92 extend around the perimeter of the platform 12, and can each have continuous angles of incline around the perimeter of the platform 12.

The dirt inlets 22 are further defined by guides 94 that catch and guide dirt into the collection chamber 24. The ramps 92 are separated from each other by the guides 94. The guides 94 can be formed as curved or arcuate vanes which project upwardly from the top or inner surface of the platform 12. The guides 94 are disposed at the periphery 16 of the platform 12 and extend generally radially from the center of the platform 12 in a spiral pattern.

Figure 8:
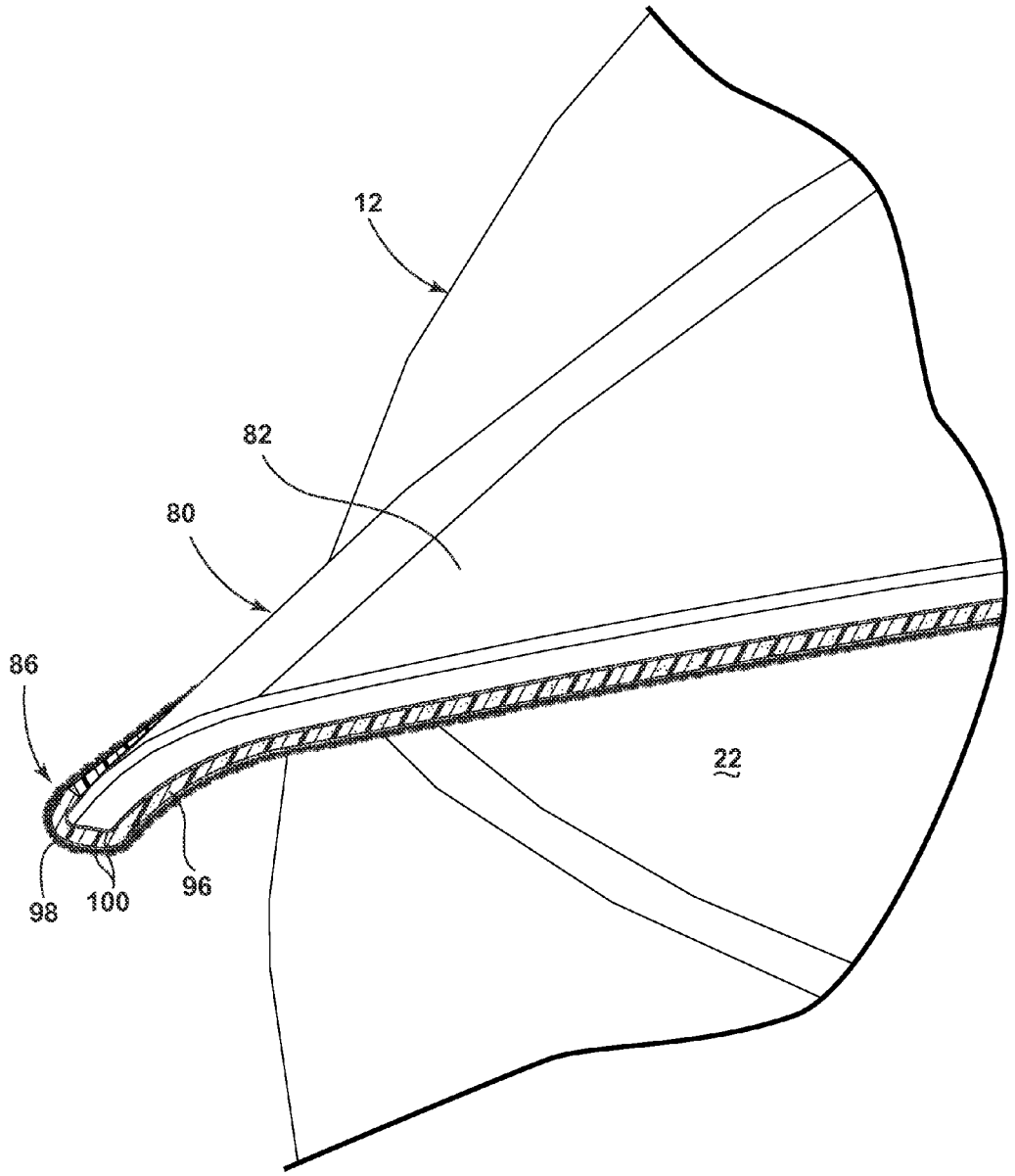
FIG. 8 is a close-up view of section VIII of the autonomous floor cleaner from FIG. 6.

FIG. 8 is a close-up view of section VIII of the autonomous floor cleaner 10 from FIG. 6. The sweeping material 86 includes a base layer 96 of foam applied to the fin 82, and an outer layer 98 of flexible bristles made of a non-woven material that are used to trap and move dirt. In one example, the foam layer 96 can have a thickness of 5-15 mm and the non-woven bristles of the outer layer 98 can have a length of 2-7 mm. The foam thickness and/or bristle length can be uniform, or can vary over the extent of the fin 82 to impart more or less stiffness to the skimmer 80. Specific examples of foam for the base layer are cellular silicone foam such as Bisco® Silicone Foam or a microcellular urethane foam, such as Poron® Foam, which are both commercially available from Rogers Corporation. Specific examples of the non-woven material for the outer bristle layer are polypropylene, polyethylene or polyester micro-fibers, which can be attached to a non-woven backing layer or woven fabric, scrim or screen layer, for example. The layers 96, 98 can be attached using any suitable method, including using a glue or adhesive 100. Alternatively, the sweeping material 86 can be omitted and the fins 82 can be configured to contact the surface to be cleaned directly.

Figure 9:
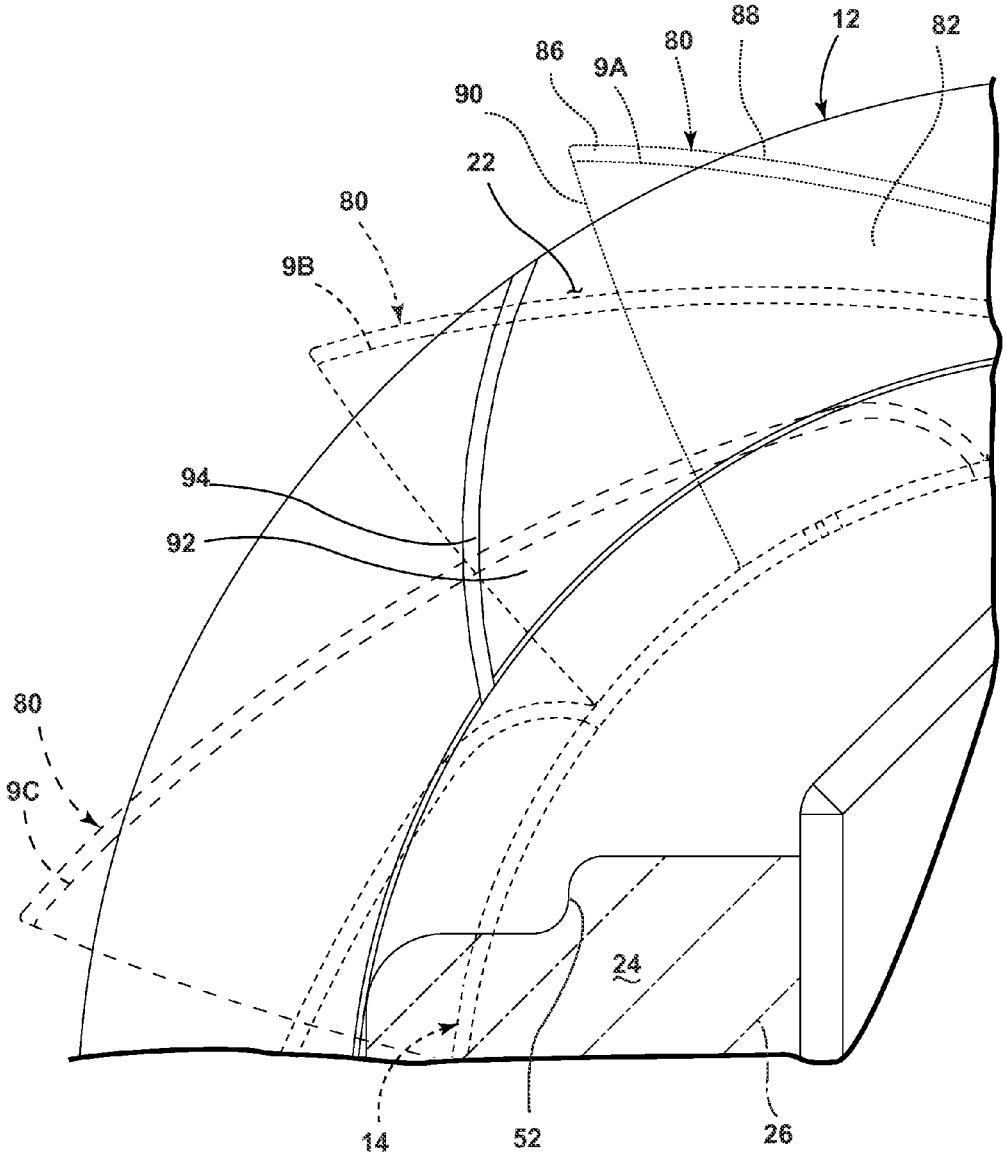
FIG. 9 illustrates a portion of the operation of the floor cleaner from FIG. 6.

FIG. 9 illustrates a portion of the operation of the floor cleaner 10 from FIG. 6. For clarity, the top plate 14 and skimmers 80 are shown in phantom line. In operation, as the top plate 14 rotates, the skimmers 80 are configured to sweep dirt inwardly in a skimming or scooping motion through the peripheral dirt inlets 22. The skimmers 80 are configured to slide up the ramps 92 and over the guides 94 to push dirt inwardly toward the centrally located collection chamber 24. The fins 82, as well as the entire top plate 14, can be made from a resilient plastic or foam, that can elastically bend and flex over the guides 94 as the top plate 14 rotates.

Some exemplary positions of one of the skimmers 80 are shown in FIG. 9 to illustrate the skimming or scooping motion. As the skimmer 80 sweeps over the surface to be cleaned as indicated at 9A, dirt is guided toward the dirt inlet 22 defined between the skimmer 80 and ramp 92 by the sweeping material 86 on the fin 82. The dirt enters the floor cleaner 10 and is guided up the ramp 92. As the skimmer 80 rotates past the guide 94, the fin 82 flexes over the guide 94 as indicated at 9B. The guide 94 prevents dirt from being carried with the top plate 14 as the sweeping material 86 moves over the guide 94. The dirt is guided into collection chamber 24 via the dirt opening 52 located at the end of the guide 94; as shown herein the sweeping material 86 may not push the dirt all the way into the collection chamber 24, but may provide enough motive force to move the dirt up the ramp 92 and into the dirt opening 52 as indicated at 9C.

Figure 10:
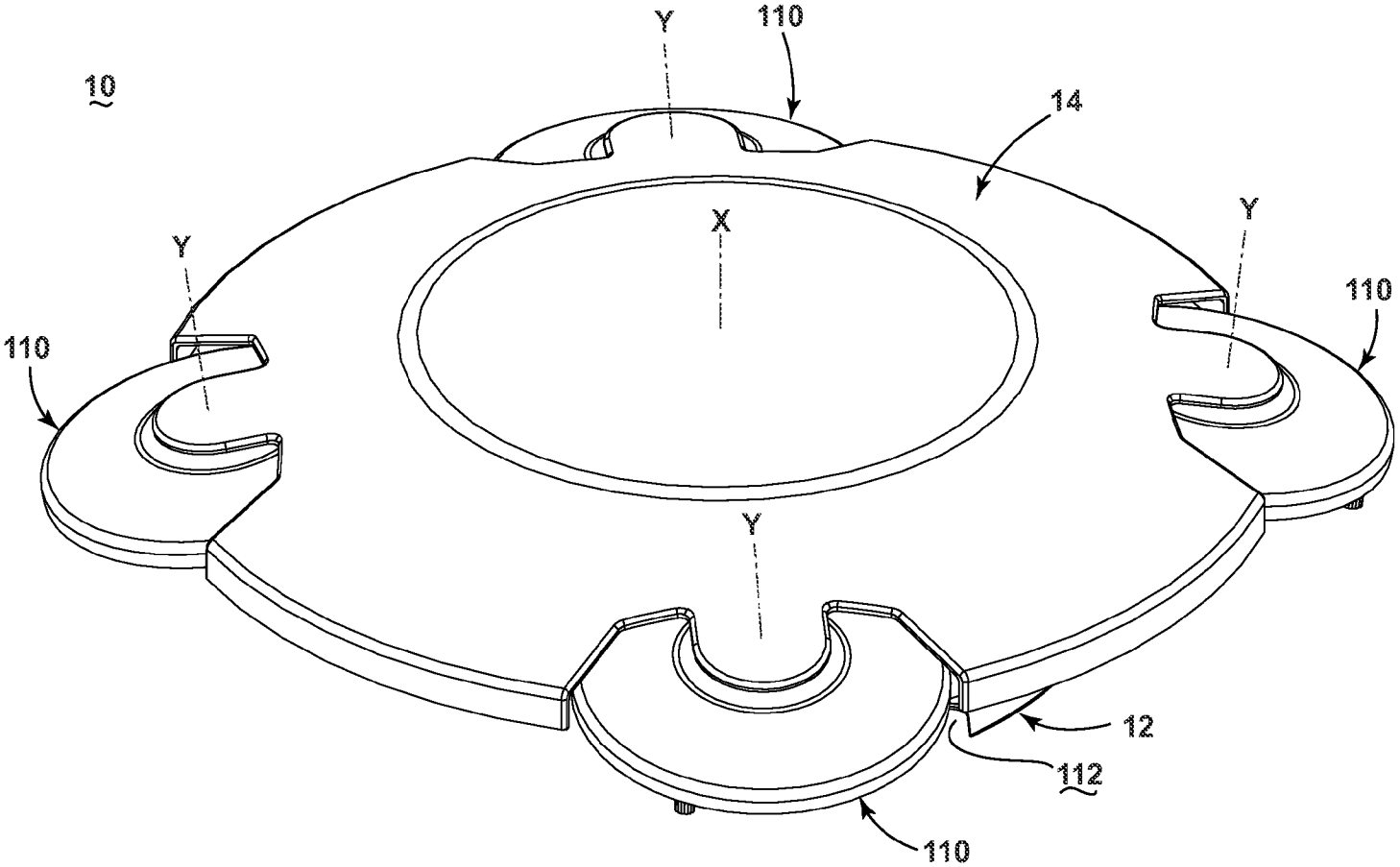
FIG. 10 is a perspective view of an autonomous floor cleaner according to a third embodiment of the invention.

FIG. 10 is a perspective view of an autonomous floor cleaner 10 according to a third embodiment of the invention. The third embodiment is substantially similar to the first embodiment, and like elements will be referred to with the same reference numerals. The third embodiment differs from the first embodiment in the configuration of the sweeping elements mounted to the top plate 14 and the dirt inlets 22. Here, the sweeping and collection system includes multiple rotatable sweeping elements 110 mounted to the top plate 14 and multiple corresponding dirt inlets 112. The dirt inlets 112 are located at the outer peripheries 16, 18 of the platform 12 and top plate 14.

In addition to rotating the top plate 14 about rotational axis X, the drive system can further be configured to rotate each sweeping element 110 about a rotational axis Y above the platform 12, independently of the movement of the platform 12 over the surface to be cleaned. The rotational axis Y can be generally vertically oriented with respect to the surface to be cleaned, such that the rotational axis Y is parallel to rotational axis X, or, as shown herein, can be non-vertical such that each rotational axis Y is slightly tilted away from the rotational axis X about the perimeter of the floor cleaner 10.

Figure 11:
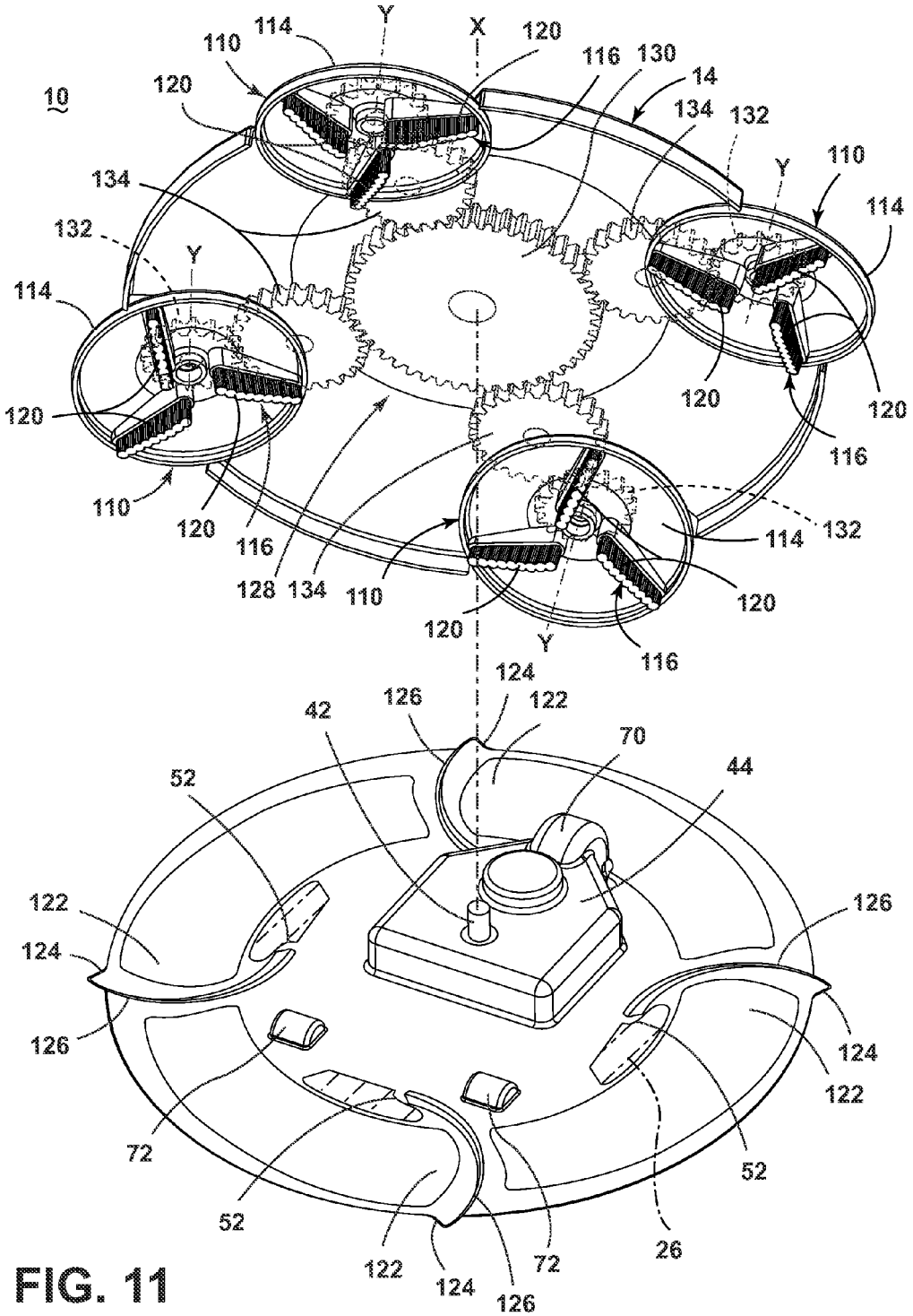
FIG. 11 is an exploded view of the autonomous floor cleaner from FIG. 10.

FIG. 11 is an exploded view of the autonomous floor cleaner 10 from FIG. 10. The sweeping elements 110 can include rotating satellite brushes that are at least partially in register with the floor surface. The satellite brushes include a disc-shaped brush housing 114 rotatably mounted on the top plate 14 and brushes 116 mounted on the underside of the brush housing 114, each of which includes a plurality of bristle tufts 118 arranged in multiple strips 120. The brush strips 120 can be disposed around the periphery of the brush housing 114 and can be diametrically offset on brush housing 114. The bristle tufts 118 can be arranged in generally linear rows such that the brush strips 120 are straight; alternatively, the bristle tufts 118 can be arranged in curved or helical rows. Optionally, the outboard bristle tufts 118 can be angled or flared outwardly so that the ends of those tufts 118 extend beyond the periphery of the brush housing 114. The platform 12 can cover the innermost portion of the sweeping elements 110, such that only the outermost brush strips 120 are in register with the floor surface as the sweeping elements 110 rotate relative to the top plate 14. The remaining portions of the brush strips 120 are in register with the top or inner surface of the platform 12.

The dirt inlets 112 are at least partially defined by ramps 122 on the top or inner side of the platform 12 which help direct dirt swept by the sweeping elements 110 toward the collection chamber 24 and which can correspond in number to the number of sweeping elements 110. The ramps 122 extend around the perimeter of the platform 12, and can each have continuous angles of incline around the perimeter of the platform 12. The ramps 122 can have inlet extensions 124 which project radially outwardly from the periphery 16 of the platform 12 and form an entrance for dirt to the dirt inlets 112.

The dirt inlets 112 are further defined by guides 126 which catch and guide dirt into the collection chamber 24. The brush strips 120 can be configured to slide along the guides 126 to push dirt inwardly toward the collection chamber 24. The guides 126 can be formed as curved or arcuate vanes which project upwardly from the top or inner surface of the platform 12. The guides 126 are disposed at the periphery 16 of the platform 12 and extend generally radially from the center of the platform 12 in a spiral pattern. In an alternate configuration of this embodiment, the inlet extensions 124 and guides 126 can be omitted.

Each sweeping element 110 is indirectly coupled to the motor 28 by a drive link that operably couples the rotation of the sweeping element to the rotation of the top plate 14. The drive link shown herein is a gear train 128, but may be another suitable linkage system including one or more gears, cranks, belts, or a combination thereof. The illustrated gear train 128 can include a drive gear 130 carried on the coupling 48, a driven gear 132 carried on the brush housing 114, and at least one intermediate gear 134 coupling the drive gear 130 and the driven gear 132. In one example, the gear ratio between the sweeping elements 110 and the top plate 14 can be about 3:1; however, the gear ratio can be adjusted to achieve rotational speeds of the top plate 14 and sweeping elements 110 for optimal sweeping and debris pick-up performance. Additionally, the gear ratio can be adjusted so that the brush strips 120 are oriented in a generally orthogonal orientation relative to the guides 126 as the strips 120 intersect the guides 126.

Figure 12A:
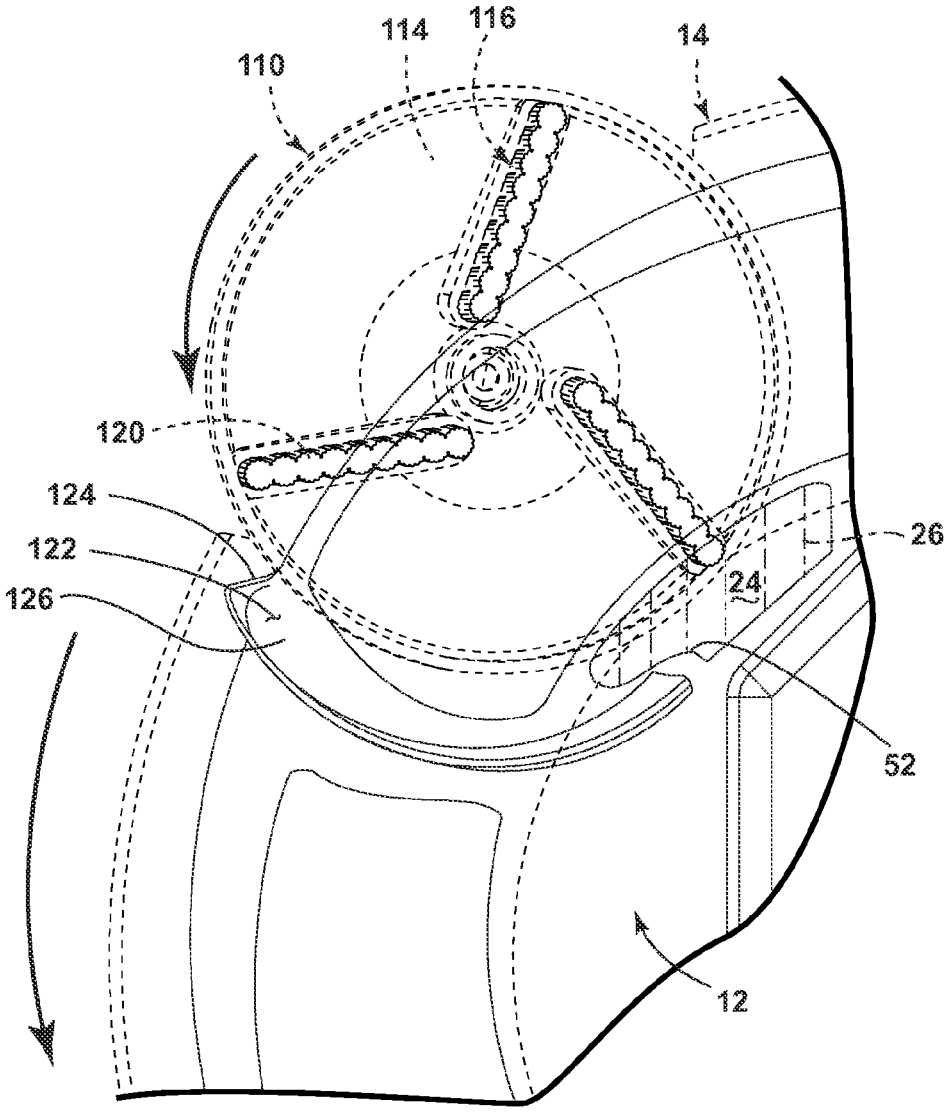
FIGS. 12A-B illustrate a portion of the operation of the floor cleaner from FIG. 10.
Figure 12B:
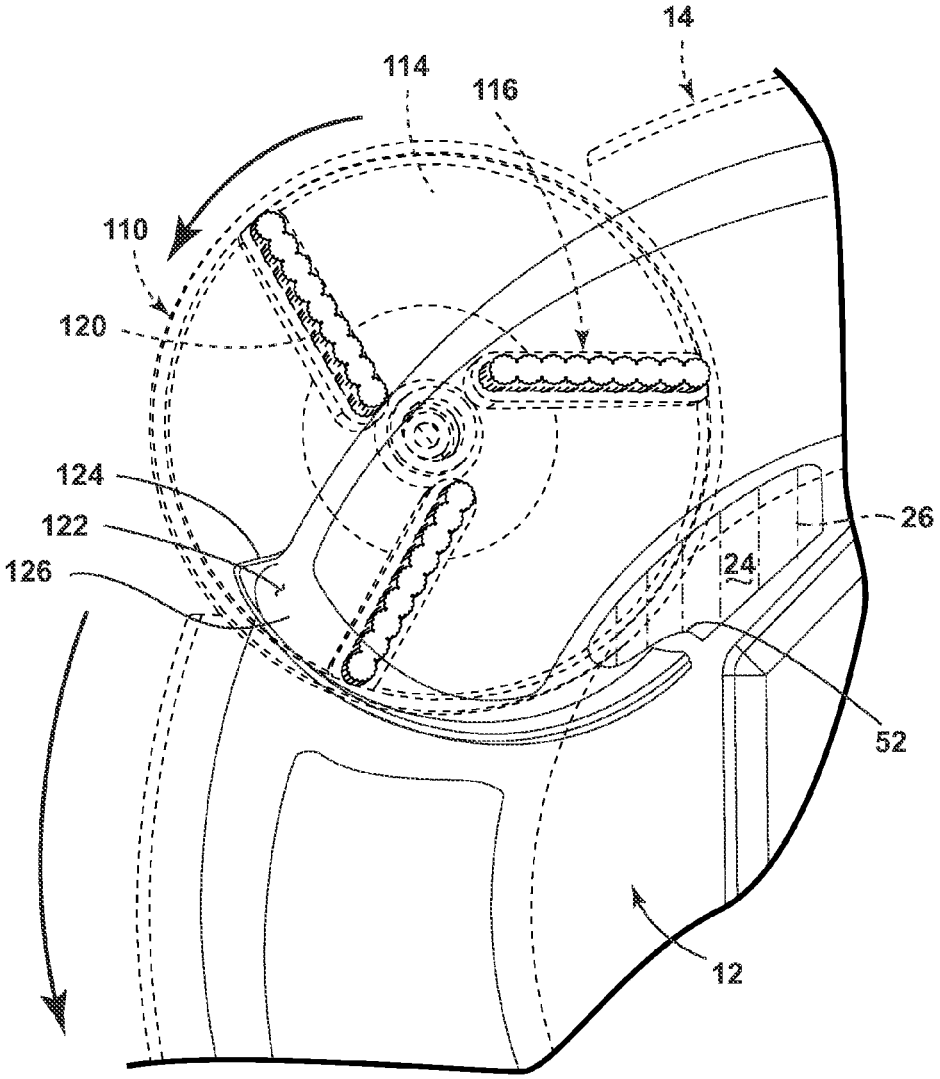

FIGS. 12A-B illustrate a portion of the operation of the floor cleaner 10 from FIG. 10. For clarity, the top plate 14 and sweeping elements 110 are shown in phantom line. In operation, as the top plate 14 rotates, the sweeping elements 110 also rotate and the brush strips 120 are configured to sweep dirt inwardly in a skimming or scooping motion through peripheral dirt inlets 112 formed in the platform 12, towards the centrally located collection chamber 24.

Some exemplary positions of one of the sweeping elements 110 are shown in FIGS. 12A-B to illustrate the skimming or scooping motion. As the sweeping element 110 sweeps over the surface to be cleaned as shown in FIG. 12A, dirt is guided toward the dirt inlet 112. The dirt enters the floor cleaner 10 at the inlet extension 124 and is guided up the ramp 122. As the brush strips 120 rotates past the guide 126, the bristle tufts 118 begin to break over the guide 126 as shown in FIG. 12B. The guide 126 prevents dirt from being carried with the top plate 14 as the brush 116 moves over the guide 126. The dirt is guided into collection chamber 24 via the dirt opening 52 located at the end of the guide 126; as shown herein the brush 116 may not push the dirt all the way into the collection chamber 24, but may provide enough motive force to move the dirt up the ramp 122 and into the dirt opening 52.

Figure 13:
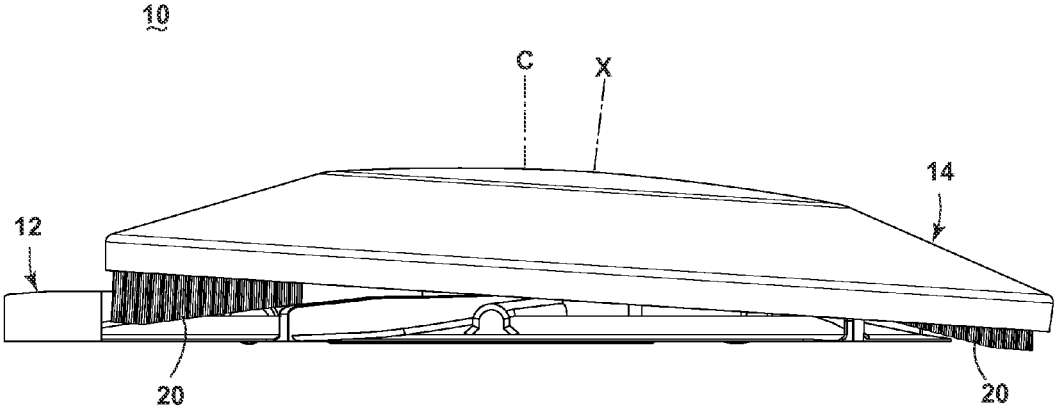
FIG. 13 is a perspective view of an autonomous floor cleaner according to a fourth embodiment of the invention.

FIG. 13 is a perspective view of an autonomous floor cleaner 10 according to a fourth embodiment of the invention. The fourth embodiment is substantially similar to the first embodiment, and like elements will be referred to with the same reference numerals. The fourth embodiment differs from the first embodiment in the configuration of the top plate 14. Here, the top plate 14 is tipped at an angle relative to platform 12, and is rotatable about a rotational axis X that is generally non-vertical with respect to the surface to be cleaned. The rotational axis X is also offset from a center axis C of the platform 12.

Figure 14C:
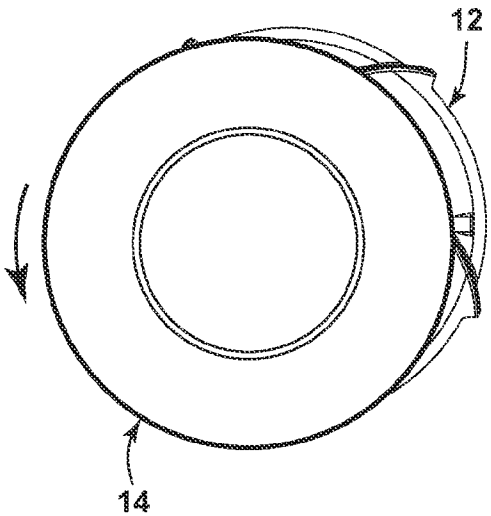
FIG. 14A-C illustrate a portion of the operation of the floor cleaner from FIG. 13.
Figure 14B:
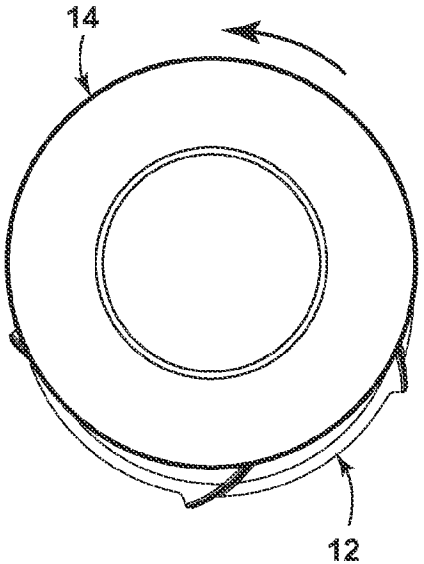
Figure 14A:
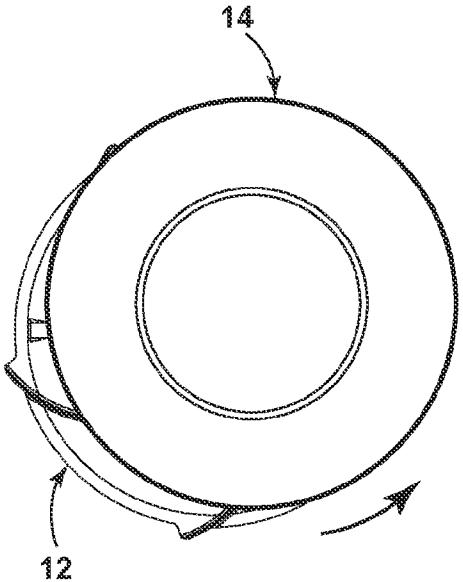

FIGS. 14A-C illustrate a portion of the operation of the floor cleaner from FIG. 13. The tilted, offset orientation of the rotating top plate 14 causes the sweeping elements 20 to reach up and over dirt on the surface to be cleaned; as the top plate 14 rotates further, the sweeping elements 20 that were in contact with the surface to be cleaned sweep dirt toward the center of the floor cleaner 10.

The autonomous floor cleaner disclosed herein includes an improved sweeping system. One advantage that may be realized in the practice of some embodiments of the described autonomous floor cleaner is that dirt is collected around the entire periphery of the floor cleaner 10. Prior art autonomous sweepers are directional, and only pick up dirt only at one side of the floor cleaner. Further, prior autonomous sweepers often just push dirt in front of the floor cleaner without actually picking up the dirt. The autonomous floor cleaner of the invention uses a rotating top plate to carry the sweeping elements, which draws dirt up corresponding ramps and into the collection chamber using a scooping or skimming motion.

Another advantage that may be realized in the practice of some embodiments of the described autonomous floor cleaner is that the floor cleaning combines the sweeping action of the rotating top plate 14 with the dusting action of the dusting cloth 26 for a more comprehensive cleaning performance. The dusting cloth 26 further forms a portion of the collection chamber 24 and provides an easy and convenient way to empty collected dirt from the floor cleaner 10.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. An autonomous floor cleaner comprising:
a base adapted for movement over a surface to be cleaned;
a top coupled with the base;
at least one sweeping element associated with the top;
a collection chamber associated with the base; and
a drive system associated with the base;
wherein the drive system is coupled to the top to rotate the top relative to the base about a top axis.

2. The autonomous floor cleaner from claim 1, wherein the at least one sweeping element extends beyond the base.

3. The autonomous floor cleaner from claim 1, wherein the top axis is non-perpendicular to the base.

4. The autonomous floor cleaner from claim 1, wherein the at least one sweeping element comprises at least one of a brush strip, a resilient fin, or a rotating brush.

5. The autonomous floor cleaner from claim 1, wherein the at least one sweeping element comprises at least one of brush strip provided on an underside of the top.

6. The autonomous floor cleaner from claim 5, wherein the at least one brush strip comprises a plurality of bristles, with at least some of the bristles extending outwardly beyond the periphery of the top.

7. The autonomous floor cleaner from claim 1, wherein the at least one sweeping element comprises at least one resilient fin that carries a sweeping material comprising a layer of foam and a layer of bristles.

8. The autonomous floor cleaner from claim 1, wherein the at least one sweeping element comprises at least one rotating brush, and the drive system rotates the at least one rotating brush about a brush axis.

9. The autonomous floor cleaner from claim 1, wherein the drive system is further coupled with the base for moving the base over the surface to be cleaned, wherein the top axis is generally perpendicular to the direction of movement of the base over the surface to be cleaned.

10. The autonomous floor cleaner from claim 1, wherein the drive system comprises a motor coupled with the top for rotating the top about the top axis.

11. The autonomous floor cleaner from claim 10, wherein the drive system further comprises at least one wheel coupled with the motor and the base for propelling the base over the surface to be cleaned.

12. The autonomous floor cleaner from claim 1 and further comprising at least one dirt inlet at the periphery of the base, wherein the dirt inlet is in communication with the collection chamber.

13. The autonomous floor cleaner from claim 12, wherein the at least one dirt inlet is at least partially defined between the base and the top.

14. The autonomous floor cleaner from claim 12, wherein the at least one dirt inlet is at least partially defined by a guide provided on the base for directing dirt into the collection chamber.

15. The autonomous floor cleaner from claim 12, wherein the base comprises at least one ramped surface at least partially defining the at least one dirt inlet.

16. The autonomous floor cleaner from claim 15, and further comprising an opening to the collection chamber formed in the base near an upper portion of the ramped surface.

17. The autonomous floor cleaner from claim 15, and further comprising a guide adjacent to the at least one ramped surface for directing dirt into the collection chamber, wherein the at least one dirt inlet is further at least partially defined by the guide.

18. The autonomous floor cleaner from claim 17, wherein the guide comprises a curved vane which projects upwardly from the base and extends along the ramped surface.

19. The autonomous floor cleaner from claim 1 and further comprising a dusting cloth coupled to a bottom surface of the base.

20. The autonomous floor cleaner from claim 19, wherein the dusting cloth forms a portion of the collection chamber.

* * * * *